US005617903A

United States Patent [19]

Bowen, Jr.

[11] Patent Number: 5,617,903

[45] Date of Patent: Apr. 8, 1997

[54] PAPERMAKER'S FABRIC CONTAINING MULTIPOLYMERIC FILAMENTS

[76] Inventor: David Bowen, Jr., 9349 Old A1A, St. Augustine, Fla. 32086

[21] Appl. No.: 610,267

[22] Filed: Mar. 4, 1996

[51] Int. Cl.[6] ..... D03D 23/00

[52] U.S. Cl. ..... 139/383 A; 442/193; 442/199; 442/200; 442/201

[58] Field of Search ..... 139/383 A; 428/225, 428/229, 234, 373, 374, 397, 257

[56] References Cited

U.S. PATENT DOCUMENTS 5,097,872 3/1992 Laine et al. ..... 428/229
5,360,656 11/1994 Rexfelt et al. ..... 428/229
5,407,737 4/1995 Halterbeck et al. ..... 428/229
5,421,377 6/1995 Bonigk ..... 428/229
5,449,548 9/1995 Bowen ..... 428/229

*Primary Examiner*—James J. Bell

[57] ABSTRACT

A papermaker's fabric constructed from polymeric fibers with 15 percent or more of the fabric'fibers larger than 100 denier and multipolymeric, the multipolymeric fibers containing two or more distinct polymeric regions within their cross sections. The multipolymeric fibers may be constructed in a sheath-core, side by side, or islands in the stream form. The components of the multipolymeric fibers are each selected to provide a combination of properties not available from any single polymer fiber.

7 Claims, 1 Drawing Sheet

PAPERMAKER'S FABRIC CONTAINING MULTIPOLYMERIC FILAMENTS

BACKGROUND OF THE INVENTION

In the production of paper, woven, spiral, and especially constructed fabric belts are utilized to support and transport the cellulosic fibers as they are moved through the papermaking process and converted from a thin slurry into finished paper. Mechanical stability and permeability control of these fabric belts are critical to the manufacture of consistent, high quality paper. Paper machines are generally divided into three sections; forming, where the thin slurry is partially drained and formed into a thin wet layer of pulp, press, where mechanical pressure is used to squeeze water from the pulp, and drying, where the pulp sheet is heated against hot rolls and converted into the paper sheet. As paper machine speeds have increased, fabrics designed for use in the all sections of papermaking machines are increasingly exposed to higher temperatures and more damaging environmental conditions. This is especially true in the dryer section. These more extreme service conditions have caused the service life of dryer fabrics to be less than satisfactory. The need for affordable high performance fibers and fabrics for use under these more demanding conditions has led to a continuing search for materials and constructions which will improve the service life of dryer fabrics.

DESCRIPTION OF THE PRIOR ART

As the speeds, tensions and environmental conditions in the papermaking process have become more demanding, the fabrics used to transport the paper through the machine have changed from felted material to specialized, high technology fabrics. In U.S. Pat. 3,653,961, Lefkowitz gives background on these early changes in paper machine felt materials. The materials of construction have evolved from natural fibers such as cotton or wool to fibers manufactured from polymeric materials such as nylon, polyester and polyphenylene sulfide. The general term "felt" is still used, even though most paper machine fabrics are now of woven or spiral design and construction. No completely satisfactory single material has yet been found to meet current demands of performance, cost and durability for fibers used in these fabrics.

Polyhexamethylene adipamide (Nylon-66), for example, is very good in wear resistance, hydrolytic stability, heat stability and cost, but is not dimensionally stable under conditions found in modem paper machine dryers. Polyesters such as polyethylene terephthalate (PET) have good dimensional stability, but even with addition of carbodiimide stabilizers, depolymerization by hydrolysis is still above acceptable levels. Polyphenylene sulfide (PPS) has very good resistance to heat and hydrolysis, but poor wear performance and poor flexibility which leads to unsatisfactory knot strength performance.

In U.S. Pat. 5,405,685, Patel describes some of these problems and proposes use of fibers based on use of a polyethylene naphthalate (PEN) polyester or blends of PEN with other polymers with special emphasis on overcoming hydrolytic degradation. Patel also cites patent 5,169,499 as describing a copolyester of 1,4-dimethylolcyclohexane, terephthalic acid and isophthalic acid (PCTA) as an attempt to overcome use problems under paper machine dryer conditions. PCTA has been found to have significant degradation problems under dry heat conditions found in modem paper dryers.

In patent 5, 104,724, Hsu claims the use of fibers made from polyetheretherketone (PEEK) to construct dryer fabrics. This polymer does appear to meet all the performance requirements listed above, but suffers in practical applications from its extremely high cost.

In patent 5,230,371 and patent 5,343,896, Lee et. al. describe an approach to improved fabric life where the dryer fabric is constructed in "layers" from the paper side to the exterior and where different polymers are used for the fibers of the separate layers. For example, one fabric description utilized Nylon-66 fibers (hydrolysis resistance and good wearability) for the fabric's paper side, PET fibers (dimensional stability) for the machine side and PPS fibers (heat and hydrolysis resistance) for the interior weft fibers of the fabric.

In patent 4,202,382, Westhead describes an approach to improved fabric durability where the fibers are constructed with a core fiber wraped with an aramid fiber. PET is given as an example of core fiber and Nomex and Kevlar, products of the DuPont de Nemours & Company, are used as the wrapping fibers.

In patents 5,361,808, 5,449,548, and application Ser. No. 08/390,869, Bowen teaches the use of shaped fibers for specific flexibility requirements and for economy of material use.

In business areas unrelated to paper production, use of simultaneously extruded sheath core and bicomponent fibers has been used to achieve specific properties not available from a single polymer. For example, a sheath of lower melting polymer extruded over a higher melting polymer may be used to form fibers which can be fused together into shaped articles by application of heat. Patent 5,284,704 by Kochesky et. al. is an example of this sheath core technology. Another example of sheath core technology may be found in the production of tire yarn, where Nylon-66 is extruded over PET to achieve good rubber adhesion and high fabric stability. Patent 5,468,555 by Lijten is a good example of this type process.

In the following sections of this patent, polystyrene will be identified as PS, polyethylene will be identified as PE etc. The abbreviations will attemp to follow current U.S. fiber and fabric practice for polymer identification.

SUMMARY OF THE INVENTION

This invention provides papermaker's and industrial fabrics which contain 15 percent or more of co-extruded multicomponent filaments larger than 100 defiler where the filament design places selected polymers within the filament in such a way as to maximize performance and minimize cost. Round, ribbon and modified cross section filaments may be used, depending on the particular function which the filament is expected to provide within the fabric. For one example, Nylon-66 may be spun as a sheath over hydrolytically stabilized PET within a filament 0.36 by 0.55 mm in cross section to give a warp yarn. The exterior Nylon sheath's hydrolysis resistance and very good wear properties protect the PET core. At the same time, the fiber benefits from the excellent dimensional stability provided by the PET. While there are limits and conditions on polymer compositions which can be co-extruded into filaments, most polymers which have melting points within 75 degrees centigrade of one another can currently be spun into multicomponent fibers. In the case where a material such as PEEK is used, it's much higher melting point than Nylon-66 or PET (120 deg. C.) will require special spinning equipment which will keep the polymer streams separate until they must be united in the spinneret. The percentage of each polymeric component can be varied between 10 to 90 percent, with the more common range being 30 to 70 percent. Besides the already mentioned sheath-core design, side by side and islands in the stream constructions can be used.

A second aspect of the invention is the potential for reduced denier and material consumption by use of modified cross sections for the multicomponent fibers. Beside the normal round and ribbon designs now used in papermaker's fabrics, this invention may have other shapes which when placed within the closest fitting circular or rectangular figure, will occupy 90 percent or less of the surrounding figure.

DETAILED DESCRIPTION OF THE INVENTION

Figure 1:
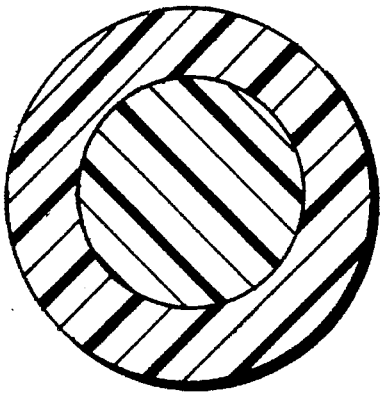
FIG. 1. is a cross section of a circular sheath core bicomponent fiber. The relative proportions of the polymer species can vary from 90/10 to 10/90.
Figure 2:
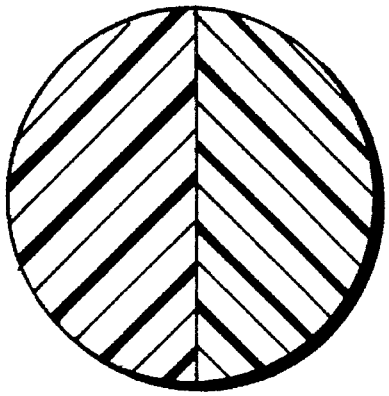
FIG. 2. is a cross section of a round side by side bicomponent fiber. This type fiber would be advantageously used as a warp fiber where the fabric construction only exposed one side of the warp to a given condition. For this fiber design, relative proportions of the components will vary from 80/20 to 20/80.
Figure 3:
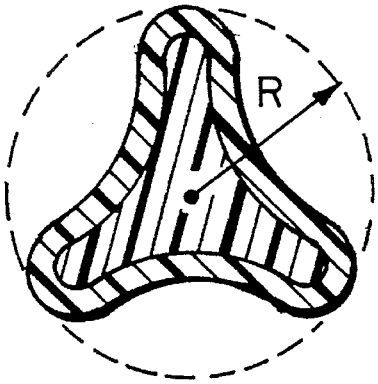
FIG. 3. is a cross section of a sheath core trilobal fiber shown circumscribed by a circle. Since this is neither a round nor ribbon fiber, the uncovered area outside the fiber and within the circle must be equal to 10 percent or more of the circle's area. The sheath for this type construction will be from 20 to 60 percent of the fiber area.
Figure 4:
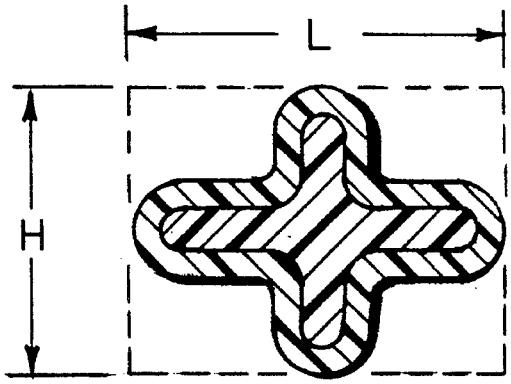
FIG. 4. is a cross section of a quadralobal sheath core fiber shown contained within the closest fitting rectangle with side lengths L and H. The area of the rectangle not covered by the fiber must again be equal to 10 percent or more of the rectangular area for fibers of this invention.
Figure 5:
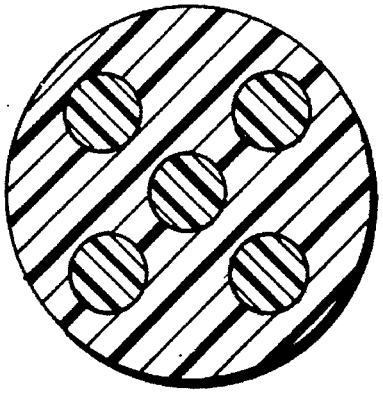
FIG. 5. is a cross section of a bicomponent fiber with an islands in the stream cross section. The stream proportions for this type design can vary from 90 to 40 percent.
Figure 6:
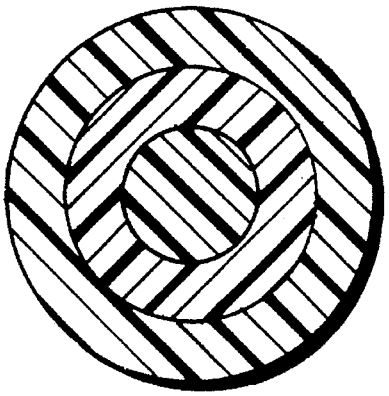
FIG. 6. is a cross section of a tricomponent fiber with a circular cross section. Any of the polymers can vary from 10 to 70 percent for this type fiber with the sum of percentages equal to 100.

This invention is a result of combining the concepts of protecting the base polymer of a filament by wrapping it with another polymer or fiber (Westhead, U.S. Pat. No. 4,202,382), using high performance materials only where required (Lee, U.S. Pat. No. 5,230,371) and reducing material use by fiber cross section (Bowen, U.S. Pat. No. 5,361,808). The multicomponent filaments used in the fabrics of this invention will have a denier greater than 100 and will be produced from melt spinnable polymers such as, but not limited to: Nylon-6, Nylon-66, PET, PCTA, PEEK, PEN, PBT, PPS, PS and PE. Alloys or combinations of polymers can be used as one of the components ifs solution like melt of the alloy can be achieved. Any number of methods to produce these filaments may be used, but the most common method is the use of twin melt extruders, meter pumps and multicomponent spin pack design. U.S. Pat. No. 5,227, 109, 5,372,865, and 4,950, 541 are referenced as giving examples of bicomponent fiber manufacturing techniques. In general, sheath-core fiber constructions will be superior to other type multicomponent designs since the sheath can be used to protect the core polymer while also providing selected mechanical functions. For the special case of materials with widely different melting points, for example PET and PEEK, the fibers may be manufactured by first spinning and quenching the PET core, then running the PET core through a second die where it is coated by the PEEK and both materials quenched again.

The fabrics of this invention will be designed to meet specified targets for cost and performance by utilizing a carefully selected pattern of fibers designed to meet specified use conditions. For example, the more expensive high performance multi-component fibers may be placed so that they are concentrated on the fabric side which is exposed to more heat or abrasion. They may be constructed preferably by weaving or spiral construction, but other fabric formation techniques may be utilized. A minimum of fifteen (15) percent by weight of the fabrics of this invention will consist of multicomponent fibers. The major invention is the combined use of polymer properties in filaments within a fabric to achieve superior performance at minimum cost.

Non limiting examples of particular fabric constructions are described below:

1. A warp yam with dimensions of 0.40 by 0.80 mm is produced with a 40 percent sheath of heat resistant Nylon-66 and a 60 percent core of hydrolysis resistant PET. Denier of the warp yam is 3400. A quadralobal weft yam with arm length of 0.50 mm and arm width of 0.15 mm is also prepared using a 50 percent heat resistant Nylon-66 sheath over a core of PPS. Denier of the weft yam is 1000. The resulting fabric has the frictional wear and hydrolysis resistance of Nylon-66 and the dimensional stability of PET. The use of the quadralobal weft yam gives added dimensional stability to the fabric by the lobes distorting against the warp yams during the weaving beatup stroke. The Nylon-66 sheath of the weft protects the PPS core from abraision while the dimensionally stable and heat and hydrolysis resistant PPS core keeps the weft yam from stretching under humid conditions. An additional benefit of the lobed weft yarn is that the denier is less than half that which would have been required to produce the same fabric utilizing round monofilament or twisted monofilaments having the same effective aspect ratio. The nylon sheath protects the polyester core of the warp from hydrolysis and wear which results in an approximately 20 percent greater service life for the fabric. Until the polyester core succumbs to hydrolysis, it prevents the warp fibers from distortion under humid conditions which is the major problem of pure nylon warps.

2. A warp identical to that of example 1 is woven with a 0.40 mm diameter weft yam comprised of a 60 percent core of hydrolysis stabilized PET over which a 40 percent sheath of heat stabilized Nylon-66 is utilized. Material savings available from modified cross section wefts are not achieved in this case, but the use of nylon sheathing in the filaments protects the polyester core from wear and hydrolysis, giving extended service life to the fabric.

3. In situations where temperature exposures would consistently be very high, above 400 degrees Farenheit for example, one preferred fabric construction would utilize round warp fibers to minimize contact area with the hot surfaces and utilize a 30 percent sheath of PEEK over PET within these warp fibers. With PEEK costing about $40 per pound and PET costing about $1.50 per pound, the material cost of this high performance fabric warp would be reduced to about $13.05 per pound, or about 67 percent below the cost of a pure PEEK fabric.

It is to be understood that calculations on exposure times and operating conditions and/or knowledge of previous fabric type performance would be required to determine polymer selection and suitability of bicomponent fiber designs for the many different possible end uses. The driving force for the overall concept is to carefully study the requirements of the process, then design the best combination of fabric construction and multicomponent fibers to meet these needs.

The following grid is proposed for a first screening technique.

| Temperature | Warp | Weft |
|---|---|---|
| low | PET or PEN | PET or PEN |
| medium | Nylon-66 over PET or PPS | Nylon-66 over PET or PPS |
| high | PEEK over PET or PPS | PEEK over PPS |

The methods disclosed by Lee et. al. in the previously mentioned U.S. Pats. No. 5,230,371 and 5,343,896, where warp fibers are restricted to one side of the fabric could be used to only require one higher performance multicomponent warp fiber, but constructions of this type may be too thick for selected applications.

It should also be specifically pointed out that it is often required that compatabilizers, special polymers and carefully controlled spinning conditions may be required to produce these multicomponent fibers. For example, antimony free PET gives much better adhesion to Nylon-66 and addition of several weight percent of lactam polyol polyacyl lactam to one or both polymers also significantly improves interpolymer adhesion. For bonding polyolefins to nylons and polyesters, maleic anhydride is a very useful additive.

What is claimed is:

1. A woven papermaker's fabric, characterized in that more than 50 percent of the filaments of said fabric are formed from manmade polymeric materials and in that at least 15 percent of said polymeric filaments are characterized as larger than 100 denier and multipolymeric, containing two or more distinct, regular, continuous and uniform polymeric regions within the filament's cross section.

2. The papermaker's fabric of claim 1, where the multipolymeric filaments are bicomponent filaments with the distinct polymeric regions arranged within the filament cross section in a sheath core design.

3. The papermaker's fabric of claim 1, where the multipolymeric filaments are bicomponent filaments with the distinct polymeric regions arranged within the filament cross section in as island in the stream design.

4. The papermaker's fabric of claim 1, where the multipolymeric filaments are bicomponent filaments with the distinct polymeric regions within the filament cross section in a side by side design.

5. The papermaker's fabric of claim 1, where the multipolymeric filaments are round.

6. The papermaker's fabric of claim 1, where the multipolymeric filaments have a cross section where the overall filament width to thickness ratio is more than 1.35 to 1.0.

7. The papermaker's fabric of claim 1, where the multipolymeric filaments have a shape which, when the filament cross section is placed into the closest fitting rectangle or circle, will occupy less than 90 percent of the area of the enclosing figure, excluding only papermaker's fabrics having X shaped filaments characterized in the fabric by a distinct sinusoidal pattern and one flattened side.

* * * * *